US010474057B1

(12) United States Patent
Stafford et al.

(10) Patent No.: US 10,474,057 B1
(45) Date of Patent: Nov. 12, 2019

(54) DEVELOPER BIAS AND ACTIVATION DELAY SYSTEM AND METHOD

(71) Applicant: Toshiba TEC Kabushiki Kaisha, Shinagawa-ku (JP)

(72) Inventors: Don W. Stafford, Lexington, KY (US); Bryan McKinley, Lexington, KY (US)

(73) Assignee: Toshiba TEC Kabushiki Kaisha, Shinagawa-ku (JP)

( * ) Notice: Subject to any disclaimer, the term of this patent is extended or adjusted under 35 U.S.C. 154(b) by 0 days.

(21) Appl. No.: 16/172,225

(22) Filed: Oct. 26, 2018

(51) Int. Cl.
*G03G 15/06* (2006.01)

(52) U.S. Cl.
CPC ..... *G03G 15/065* (2013.01)

(58) Field of Classification Search
CPC ..... G03G 15/065; G03G 15/0121; G03G 15/0173; G03G 15/0266; G03G 2215/0177
USPC ..... 399/38, 46, 53–56, 110, 111, 168, 170
See application file for complete search history.

(56) References Cited

U.S. PATENT DOCUMENTS

| | | | | |
|---|---|---|---|---|
| 4,714,942 | A | 12/1987 | Nakanishi | |
| 5,500,720 | A | 3/1996 | Karasawa | |
| 8,768,184 | B2 * | 7/2014 | Ishida | G03G 15/0853 399/27 |
| 2012/0002985 | A1 * | 1/2012 | Katayama | G03G 15/161 399/21 |

* cited by examiner

*Primary Examiner* — Hoan H Tran
(74) *Attorney, Agent, or Firm* — Ulmer & Berne LLP

(57) ABSTRACT

A system and method for reducing toner waste during startup of a print operation for electrostatic printers includes a controller that is configured to delay the biasing and rotation of a developer roller until initially uncharged portions of a photoconductive drum have rotated past the developer roller. At the start of a print operation the controller rotates a photoconductive drum and activates a charge corona to put an initial charge on the photoconductive drum, which is thereafter selectively removed in accordance with the image to be printed. The charge corona and developer roller are angularly displaced from one another such that at the start of a print job uncharged portions of the photoconductive drum are initially rotated past the developer roller. Delaying the biasing and rotation of the developer roller prevents toner from being transferred from the developer roller to the initially uncharged portions of the photoconductive drum.

20 Claims, 4 Drawing Sheets

DEVELOPER BIAS AND ACTIVATION DELAY SYSTEM AND METHOD

TECHNICAL FIELD

This application relates generally to devices for reducing toner loss during electrostatic process units (EPU) start up, and more particularly to delaying the rotation and charging of the developer unit of an EPU during start up.

BACKGROUND

Document processing devices include printers, copiers, scanners and e-mail gateways. More recently, devices employing two or more of these functions are found in office environments. These devices are referred to as multifunction peripherals (MFPs) or multifunction devices (MFDs). As used herein, MFP means any of the forgoing.

An electrostatic process unit (EPU) in many toner-based printers and multifunction peripherals performs the printing function. The EPU typically comprises a photoconductive drum, a developer roller, and a charge unit among other components as would be known in the art. Using magnetic and electrostatic forces, the developer roller and the photoconductive drum transfer toner from an associated toner hopper to a sheet of paper where it is fused by heat to the paper. After the photoconductive drum transfers toner to the paper, a cleaner blade in the EPU removes residual toner and paper dust from the photoconductive drum.

During printer startup operations, uncharged sections of the photoconductive drum can attract toner from the developer roller. This unintentionally transferred toner is outside the print area and is removed as waste toner from the photoconductive drum and discarded. In many instances, the amount of waste toner can exceed the total amount of toner deposited on a typical 2 page print job.

BRIEF DESCRIPTION OF THE DRAWINGS

Various embodiments will become better understood with regard to the following description, appended claims and accompanying drawings wherein:

DETAILED DESCRIPTION

Figure 1:
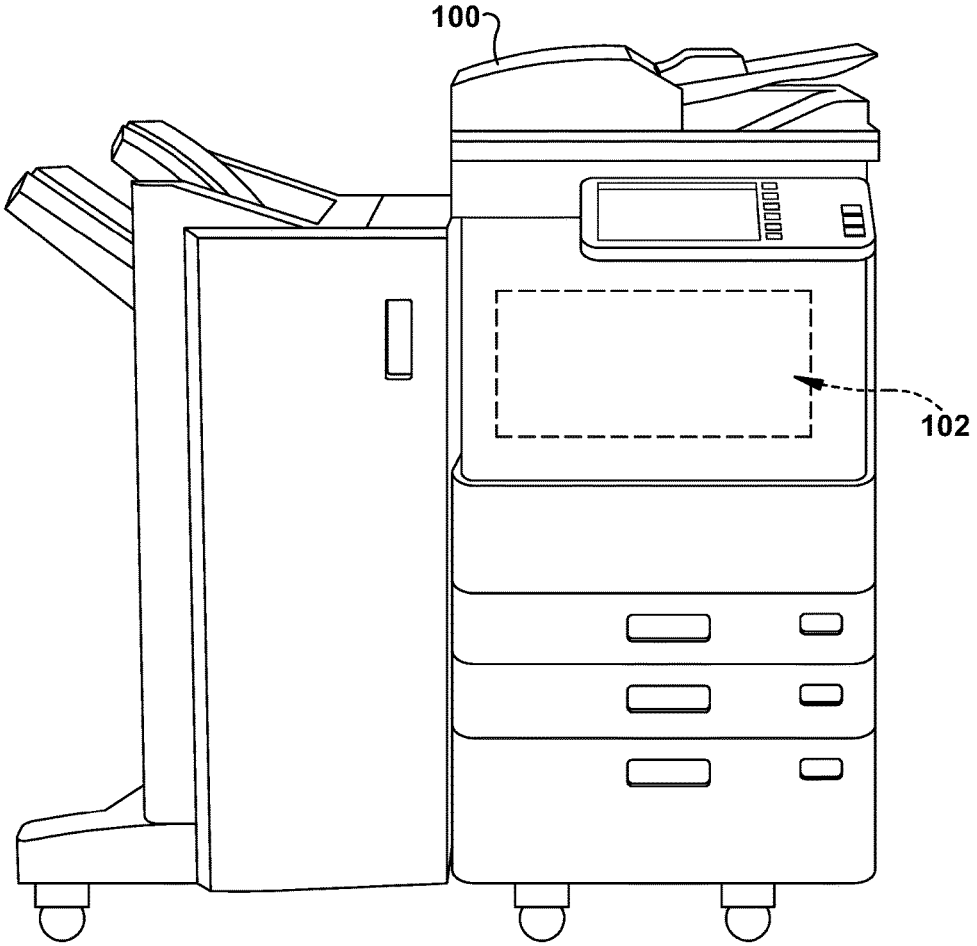
FIG. 1 is a block diagram of a multifunction peripheral.

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

In an example embodiment, a system includes a developer roller configured to attract toner from a toner hopper when the developer roller is biased, and a photoconductive drum configured to selectively attract toner from the developer roller in accordance with an image to be printed. A controller is configured to delay biasing and rotation of a developer roller until initially uncharged portions of the photoconductive drum have been rotated through a predetermined angle after a print operation has been initiated. Delaying the biasing and rotation of the developer roller prevents toner from being transferred from the developer roller to initially uncharged portions of the photoconductive drum at the start of a print operation.

In toner-based electro-photographic printers, toner is picked up by a magnetic developer roller in an electrostatic process unit, or EPU, from a toner hopper. The magnetic developer roller rotates the toner towards a photoconductive drum. During a print operation, an electrical charge is applied to the photoconductive drum by a charge corona. A laser, or one or more LEDs, is used to selectively remove charge from the photoconductive drum in accordance with a desired image to be printed.

Toner from the developer roller selectively transfers to the photoconductive drum in accordance to the image. The toner from the photoconductive drum is then transferred paper via a transfer belt and fused with the paper to form a printed page. Residual toner that is left on the photoconductive drum is removed by a cleaner blade or wiper blade and moved by an auger into a waste bin.

However, when the EPU first starts up following a period of disuse, the photoconductive drum may not have a charge, or at least not a full charge. An uncharged portion of the photoconductive drum can exist between the charge corona and the developer roller, even once the charge corona has been activated and begins to place charge on the surface of the photoconductive drum. As the photoconductive drum rotates towards the developer roller, this uncharged portion of the photoconductive drum can attract toner from the developer roller. If the developer roller is biased and rotating, toner from the hopper can be picked up by the developer roller and transferred to the uncharged section of the photoconductive drum. This toner is outside the print area and is removed by the cleaner blade and discarded, leading to unnecessary waste and ultimately higher maintenance costs. For a printer that experiences pauses between print jobs, the amount of waste toner consumed each time the EPU starts up can exceed the amount of toner deposited on a typical 2-page print job.

By delaying the developer roller drive activation and bias activation of the developer roller, the amount of toner transferred to the uncharged portion of the photoconductive drum is advantageously reduced which lowers toner usage, reduces the amount of waste toner that must be collected and discarded, and lowers maintenance costs.

With reference to FIG. 1, an example multifunction peripheral (MFP 100) is presented. The MFP 100 includes electrostatic-based, or toner-based, printing hardware 102 for performing printing operations as would be understood in the art.

Figure 2:
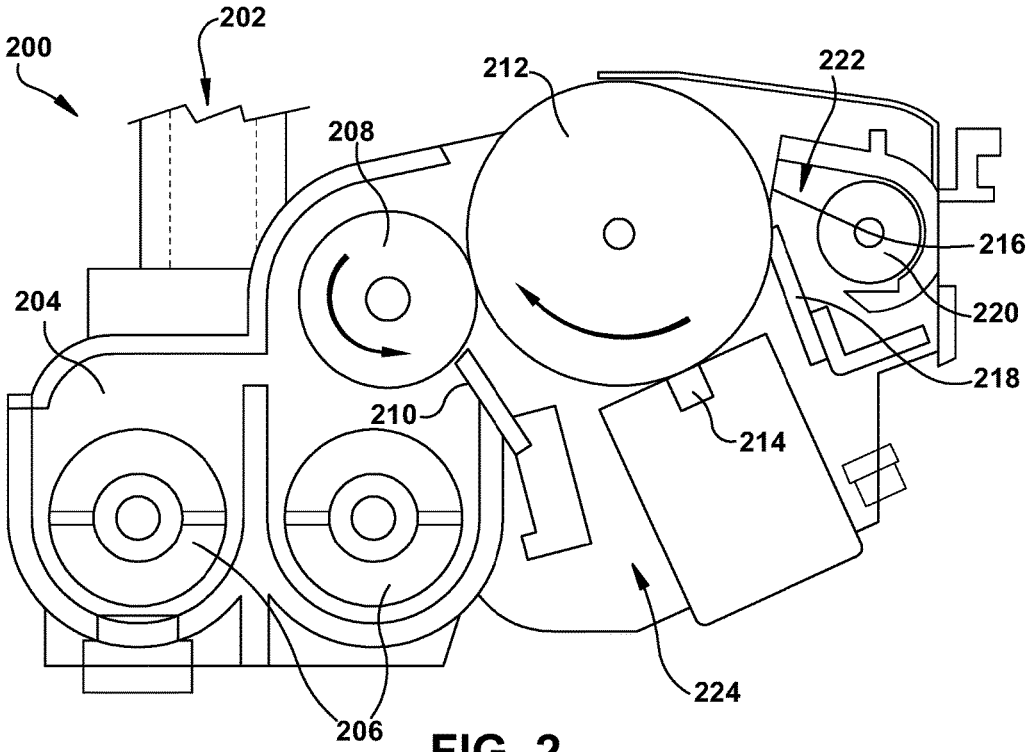
FIG. 2 is a diagram of components of an example electrostatic process unit.

With reference to FIG. 2, diagrams of an electrostatic process unit, or EPU 200, of an example laser printer are presented. The EPU 200 receives toner 202 into a toner hopper 204 of a developer unit that includes mixers 206. Toner 202 from the toner hopper 204 is picked up by the developer roller 208 that rotates towards a doctor blade 210. The doctor blade 210 removes excess toner 202 from the developer roller 208 leaving a thin evenly distributed layer of toner 202 on the developer roller 208. The developer roller 208 rotates towards the photoconductive drum 212. The photoconductive drum 212 is charged by a charge corona 214 of an associated charger unit. A laser, or one or more LEDs, that is associated with the printer produces the image to be printed by selectively removing charge from the photoconductive drum 212 accordance with the image to be printed.

As the photoconductive drum 212 rotates, toner 202 on the developer roller 208 is selectively pulled onto the photoconductive drum 212 in accordance with the image to be printed. The photoconductive drum 212 transfers the toner 202 to a transfer belt (not shown) and then to paper (not shown) after which the toner 202 is permanently fused to the paper by a fusing assembly (not shown). After transferring toner 202 to the transfer belt, the photoconductive drum 212 continues to rotate towards a cleaner blade 218 that removes any residual toner and other particles that remain on the photoconductive drum 212. A recovery blade 216 prevents removed toner and other particles from escaping from this section of the developer cavity 222 into other parts of the developer cavity 224. An auger 220 moves waste toner and other particles out of the EPU 200 to a suitable waste receptacle.

Figure 3:
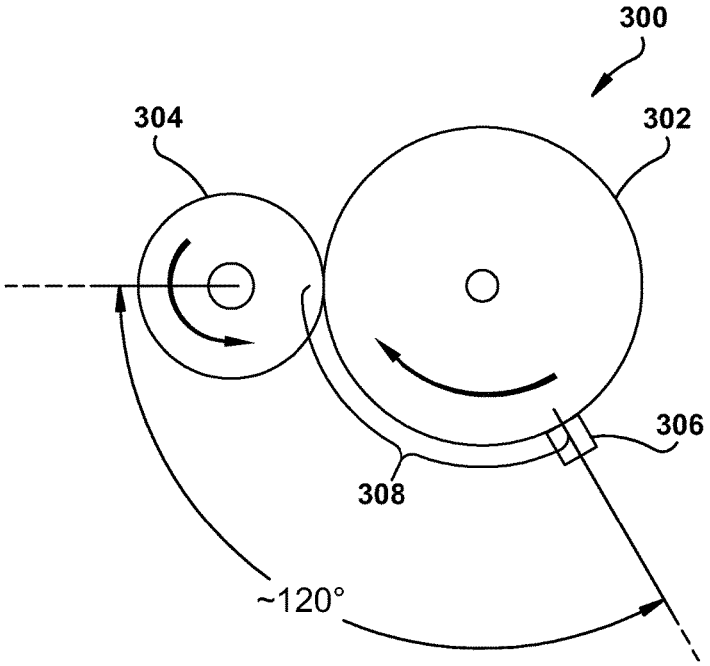
FIG. 3 is a diagram depicting the position of an uncharged section of a photoconductive drum of an electrostatic process unit.

FIG. 3 depicts the position of an uncharged section 308 of a photoconductive drum 302 of an electrostatic process unit, or EPU 300. When the EPU 300 starts up following a period of disuse, the photoconductive drum 308 initially may not have a charge, or at least not a full charge. When the EPU 300 starts up, the photoconductive drum 302 is rotated and the charge corona 306 is activated which places a charge on the photoconductive drum 302. However, an initially uncharged section 308 of the photoconductive drum 302 can exist between the charge corona 306 and the developer roller 304. The uncharged section 308 can span approximately 120 degrees depending on the relative positions of the charge corona 306 and the developer roller 304.

As the photoconductive drum 302 is rotated towards the developer roller 304, the uncharged section 308 can attract toner from the developer roller 304. If the developer roller 304 is biased and rotating during EPU 300 start up, then toner from the hopper will be picked up by the developer roller 304 and brought into proximity of the uncharged section 308 of the photoconductive drum 302. This will allow toner to inadvertently transfer from the developer roller 304 to the uncharged section 308 of the photoconductive drum 302. This toner is outside the print area and will be removed by the cleaner blade and discarded, leading to unnecessary usage of toner and the accumulation of additional waste toner in a waste toner box that will require eventual disposal. For a printer that experiences pauses between print jobs, the amount of waste toner consumed each time the EPU starts up can exceed the amount of toner deposited on a 2-page print job having approximately 2% coverage by text.

Figure 4:
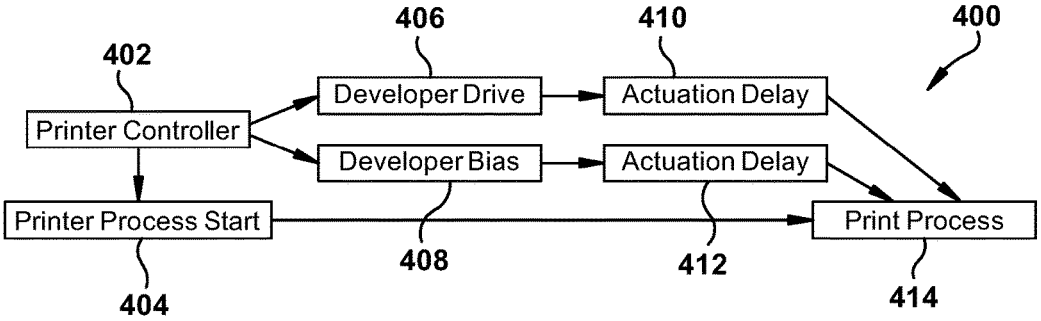
FIG. 4 is a block diagram of modules of a developer delay system.

Referring now also the FIG. 4, a developer delay system 400 delays the developer roller drive activation and bias activation to reduce the amount of toner that is transferred from the developer roller to the uncharged section of the photoconductive drum. Specifically, when the printer controller receives a print job at block 402, the print process is initiated at block 404 and the EPU is started up, causing the photoconductive drum to begin rotating and the charge corona begin place a charge on the photoconductive drum. The developer drive controller at block 406 begins an actuation delay at 410, and the developer bias controller at block 408 begins an actuation delay at block 412. Each actuation delay can be the same delay, or different delays can be used as would be understood in the art. During the actuation delay, the photoconductive drum continues to rotate and receive a charge from the charge corona, allowing all of, or a substation portion of, the uncharged portion of the photoconductive drum to rotate past the developer roller before the developer roller is biased and rotated. After the actuation delay, a bias is applied to the developer roller and the developer roller is rotated, allowing toner to be transported from the toner hopper into proximity of the photoconductive drum, and the print process proceeds at block 414.

Introducing the actuation delay on the developer roller advantageously reduces the amount of toner that is inadvertently attracted from the developer roller by the uncharged portion of the photoconductive drum and later removed as waste toner. The actuation delay can reduce the amount of waste toner collected for disposal by approximately 26% and can reduce the amount of toner used in typical print jobs by 15% or more.

Figure 5:
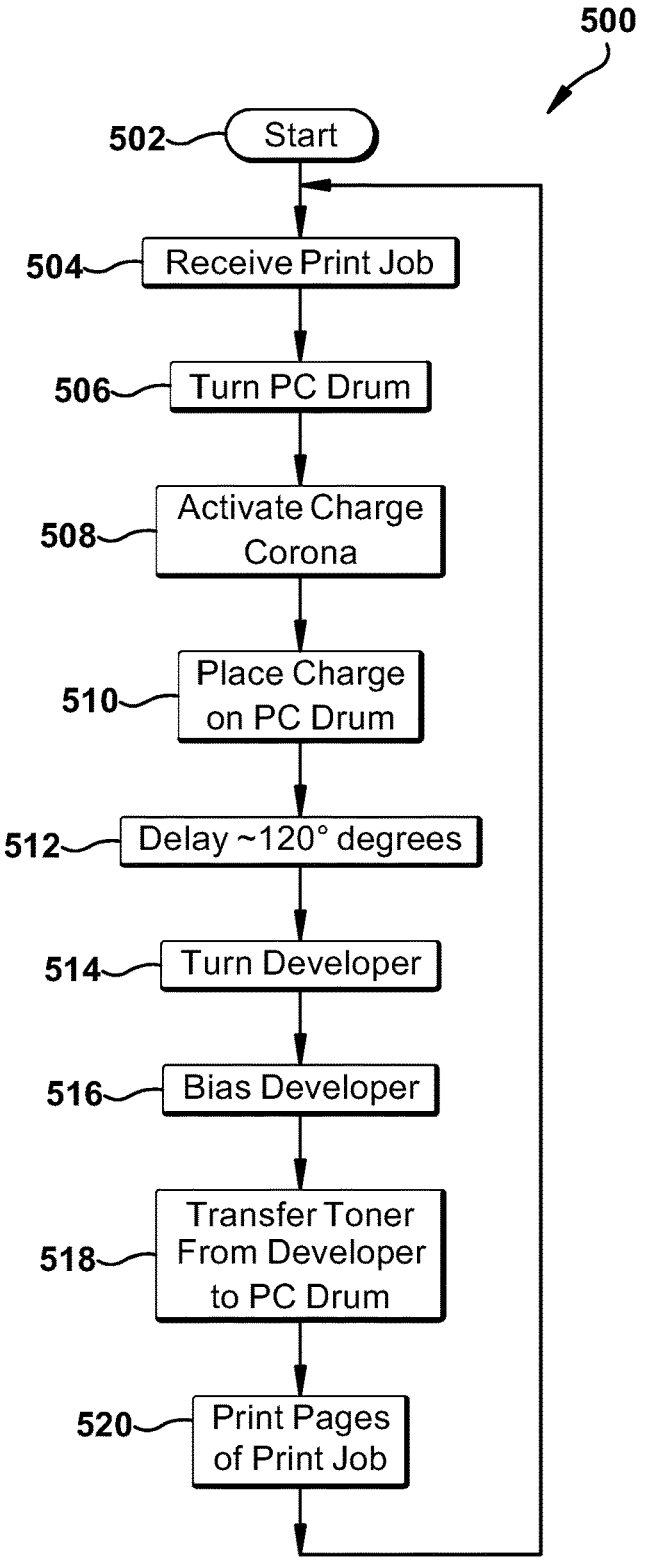
FIG. 5 is a flowchart of example operations of a developer delay system for an electrostatic process unit of a toner-based printer.

Referring now also the FIG. 5, a flowchart of example operations 500 of a developer delay system 500 is presented. Operations commence at block 502 and proceed to block 504 where a print job is received by a printer controller. At block 506, the printer controller sends a signal to begin rotating the photoconductive drum and at block 508 the charge corona is activated to begin placing a charge on the photoconductive drum at block 510. It should be noted that the operations at blocks 506 and 508 can occur concurrently or consecutively in any order.

At block 512, the operation of the developer roller is delayed to allow time for the uncharged photoconductive drum to rotate past the developer roller. At block 514 the developer roller begins rotating and at bock 516 a bias is applied to the developer roller to pick up toner from an associated toner hopper. It should be noted that the operations at blocks 514 and 516 can occur concurrently or consecutively in any order. At block 518 toner attracted to the biased developer roller is rotated into proximity of the photoconductive drum and selectively transferred in accordance with the image to be printed. At block 520 the remaining print operations are performed to print the pages of the print job after which processing returns to block 504 to await a new print job.

By delaying the developer roller drive activation and bias activation of the developer roller, the amount of toner transferred to the uncharged portion of the photoconductive drum is advantageously reduced which lowers toner usage, reduces the amount of waste toner that must be collected and discarded, and lowers maintenance costs.

In light of the foregoing, it should be appreciated that the present disclosure significantly advances the art of removing residual toner and other particles from the photoconductive drum of a toner-based print unit. While example embodiments of the disclosure have been disclosed in detail herein, it should be appreciated that the disclosure is not limited thereto or thereby inasmuch as variations on the disclosure herein will be readily appreciated by those of ordinary skill in the art. The scope of the application shall be appreciated from the claims that follow.

What is claimed is:

1. An apparatus, comprising:

a developer roller configured to attract toner from a toner hopper when biased;

a photoconductive drum configured to selectively attract toner from the developer roller in accordance with an image to be printed;

a controller configured to delay biasing and rotation of the developer roller until the photoconductive drum has been rotated through a predetermined angle after a print operation has been initiated.

2. The apparatus of claim 1, wherein the photoconductive drum is initially in a substantially uncharged state and further comprising:

a charge corona configured to place a charge on the photoconductive drum during the print operation, and wherein charge is selectively removed from the photoconductive drum in accordance with the image to be printed.

3. The apparatus of claim 2, wherein the charge corona is angularly displaced from the developer roller at approximately the predetermined angle, and wherein the controller delays biasing and rotation of the developer roller at the start of the print operation until initially uncharged portions of the photoconductive drum have rotated past the developer roller.

4. The apparatus of claim 3, wherein the predetermined angle is approximately 120 degrees.

5. The apparatus of claim 3, wherein the controller is further configured to bias and rotate the developer roller once the photoconductive drum has rotated through the predetermined angle.

6. The apparatus of claim 5, wherein the controller biases and rotates the developer roller once charged portions of the photoconductive drum have substantially rotated into proximity of the developer roller.

7. The apparatus of claim 2, wherein the controller is configured to bias and rotate the developer roller such that toner on the developer roller is brought into proximity of the photoconductive drum at substantially the time that selectively charged portions of the photoconductive drum with the image to be printed have rotated into proximity of the developer roller.

8. An multifunction printer, comprising:

an electrostatic process unit comprising a toner hopper, a developer roller configured to attract toner from the toner hopper when biased, a photoconductive drum configured to receive an initial charge, have charge removed in accordance with an image to be printed, and selectively attract toner from the developer roller in accordance with the image to be printed, and a charge corona configured to place the initial charge on the photoconductive drum; and a controller configured to selectively rotate the photoconductive drum during a print operation, selectively activate the charge corona to place the initial charge on the photoconductive drum during the print operation, selectively rotate the developer roller only after the photoconductive drum has been rotated through a predetermined angle with the charge corona activated.

9. The multifunction printer of claim 8, wherein the photoconductive drum is initially in a substantially uncharged state prior to the print operation, and wherein during the print operation charge is selectively removed from the photoconductive drum by selective impingement of light onto charged portions of the photoconductive drum.

10. The multifunction printer of claim 9, wherein the charge corona is angularly displaced from the developer roller at approximately the predetermined angle, and wherein the controller delays biasing and rotation of the developer roller at the start of the print operation until initially uncharged portions of the photoconductive drum have rotated past the developer roller.

11. The multifunction printer of claim 10, wherein the predetermined angle is approximately 120 degrees.

12. The multifunction printer of claim 10, wherein the controller is further configured to bias and rotate the developer roller once the photoconductive drum has rotated through the predetermined angle.

13. The multifunction printer of claim 10, wherein the controller biases and rotates the developer roller once charged portions of the photoconductive drum have substantially rotated into proximity of the developer roller.

14. The multifunction printer of claim 8, wherein the controller is configured to bias and rotate the developer roller such that toner on the developer roller is brought into proximity of the photoconductive drum at substantially the time that selectively charged portions of the photoconductive drum with the image to be printed have rotated into proximity of the developer roller.

15. A method, comprising:

initiating a print operation on a print engine;

activating, in response to initiating the print operation, a photoconductive drum of the print engine;

delaying activation of a developer roller of the print engine subsequent to activating the photoconductive drum;

activating the developer roller of the print engine subsequent to delaying activation of the developer roller; and performing the print operation on the print engine.

16. The method of claim 15, wherein activating the photoconductive drum further comprises:

rotating the photoconductive drum; and activating a charge corona substantially concurrent with rotating the photoconductive drum to place a charge on the photoconductive drum.

17. The method of claim 16, wherein activating the developer roller further comprises:

rotating the developer roller; and biasing the developer roller substantially concurrent with rotating the developer roller to attract toner onto the developer roller.

18. The method of claim 17, wherein delaying activation of the developer roller further comprises:

pausing rotation and biasing of the developer until the photoconductive drum has rotated through a predetermined angle.

19. The method of claim 18, wherein the predetermined angle is approximately an angle between the charge corona and the developer roller.

20. The method of claim 18, wherein the predetermined angle is approximately 120 degrees.

* * * * *